US005782188A

United States Patent [19]

Evans et al.

[11] Patent Number: 5,782,188

[45] Date of Patent: Jul. 21, 1998

[54] PYROLYTIC COMBUSTION APPARATUS AND METHOD

[76] Inventors: Marvin Evans, 8550 N. Fielding Rd.; David H. Miller, 610 E. Birch Ave., both of Milwaukee, Wis. 53217

[21] Appl. No.: 718,916

[22] Filed: Sep. 25, 1996

[51] Int. Cl.[6] ..... F23G 5/00; F23G 5/027; F23G 5/20; C10B 53/00

[52] U.S. Cl. ..... 110/346; 110/342; 110/344; 110/345; 110/229; 110/235; 110/246; 110/255; 110/210; 110/214; 110/215; 110/216; 210/773; 210/800; 266/144; 266/148; 266/158

[58] Field of Search ..... 110/229, 230, 110/235, 242, 246, 203, 210, 211, 212, 214, 215, 216, 341, 342, 344, 345, 346, 348; 266/144, 145, 146, 147, 148, 157, 158, 159; 210/767, 773, 776, 800, 803, 805

[56] References Cited

U.S. PATENT DOCUMENTS

| | | | |
|---|---|---|---|
| 1,326,039 | 12/1919 | Dunwody | 210/776 |
| 3,287,902 | 11/1966 | Khristianovich et al. | 60/39.02 |
| 3,561,379 | 2/1971 | Polsak | 588/228 |
| 3,770,419 | 11/1973 | Brown | 75/407 |
| 4,200,262 | 4/1980 | Evans et al. | 266/44 |
| 4,201,370 | 5/1980 | Evans et al. | 266/44 |
| 4,337,929 | 7/1982 | Evans | 266/248 |
| 4,399,756 | 8/1983 | Lientz | 110/346 |
| 4,485,745 | 12/1984 | Bracker et al. | 110/229 |
| 4,620,492 | 11/1986 | Vogg et al. | 588/248 |
| 4,829,911 | 5/1989 | Nielson | 110/234 |
| 4,864,942 | 9/1989 | Fochtman et al. | 110/226 |
| 4,941,822 | 7/1990 | Evans et al. | 432/112 |
| 5,170,726 | 12/1992 | Brashears et al. | 110/236 |
| 5,174,750 | 12/1992 | Flading et al. | 432/115 |
| 5,205,225 | 4/1993 | Milsap, III | 110/240 |
| 5,221,512 | 6/1993 | Sancinelli | 266/80 |
| 5,222,446 | 6/1993 | Edwards et al. | 110/235 |
| 5,382,002 | 1/1995 | Evans et al. | 266/205 |

OTHER PUBLICATIONS

CORECO, "Solving Waste Recycling Problems for Industry & Government".

*Primary Examiner*—Ira S. Lazarus
*Assistant Examiner*—Ljiljana V. Ciric
*Attorney, Agent, or Firm*—Andrus, Sceales, Starke & Sawall

[57] ABSTRACT

A method and apparatus for incinerating waste material and in particular, for incinerating particulate material resulting from the shredding of vehicles. The particulate material is fed to one end of a rotary drum, and is subjected in the drum to pyrolitic incineration in the absence of air, to generate combustible gases and a solid residue. The combustion gases and the residue are discharged from the drum to a discharge hood, where the solid residue is separated from the gases. The gases are then passed through a condenser to cool the gases to a temperature below 212° F. to thereby condense water vapor and higher boiling point hydrocarbon gases to produce hydrocarbon liquid. The condensed water vapor and hydrocarbon liquid are separated from the lower boiling point hydrocarbon gases in a liquid-gas separator and the condensed water vapor and hydrocarbon liquid are discharged into a tank of water, where the hydrocarbon liquid will form a layer on the top of the water, and can subsequently be removed, while the lower boiling point hydrocarbon gases can be discharged to an afterburner to provide complete combustion of the combustible material in the gas.

22 Claims, 3 Drawing Sheets

PYROLYTIC COMBUSTION APPARATUS AND METHOD

BACKGROUND OF THE INVENTION

The disposal of old automobiles and other vehicles has presented a serious environmental problem. One method of disposal is to subject the vehicles to a mechanical shredding operation, in which the entire vehicle is broken up into small particles or fragments which can range up to several inches in size. Ferrous metal fragments, as well as non-ferrous metal fragments, can be separated and the remaining material, which is substantially non-metallic, is often referred to as "fluff". The fluff consists of particles or fragments of materials, such as rubber, plastic, paint, insulation, glass and the like, and may contain up to 10% metal, mostly non-ferrous metals.

The "fluff" has a very high BTU value due to the presence of large quantities of rubber, plastic, paints and the like. Due to its high BTU value and its non-homogeneous nature, the incineration of "fluff" is very difficult to control, and large volumes of corrosive and polluting gases are generated. Further, the presence of metals and glass in the "fluff" can result in the formation of slag at the high temperatures of incineration.

Because of these problems, the "fluff" generated through the shredding of vehicles, has not been incinerated, but instead has been land-filled, and this presents serious environmental problems.

SUMMARY OF THE INVENTION

The invention is directed to a method and apparatus for incinerating waste material, and in particular, for incinerating "fluff" from the shredding of vehicles.

In accordance with the invention, the waste material or "fluff" is fed by an auger to one end of a sealed rotary drum, where the waste material is subjected to pyrolitic decomposition in the absence of air to generate combustion gases and a solid residue. The combustion gases consist of low boiling point hydrocarbon gases such as methane, ethane, carbon dioxide, and the like, as well as higher boiling point hydrocarbon gases, along with water vapor.

The combustion gases and solid residue are discharged from the downstream end of the drum to a discharge hood, where the solid residue is separated from the gases.

The combustion gases are then passed through a condenser to cool the gases to a temperature below 212° F. to cause condensation of the water vapor, as well as condensation of the higher boiling point hydrocarbon gases. The condensed liquid products along with the remaining combustion gases are discharged from the condenser to a liquid-gas separator. In the separator, the condensed products are fed into a tank of water, where the condensed hydrocarbons will collect as an upper oleophilic or oil layer and the oil layer can be continuously or intermittently removed from the tank, depending on the quantity of the oil that is deposited.

The lower boiling point hydrocarbon gases are discharged from the liquid-gas separator, and can be delivered to an afterburner where air is mixed with the gases, and the mixture is combusted to provide complete combustion of the hydrocarbons. Alternately, the low boiling point hydrocarbon gases can be collected and subsequently used as a fuel.

With the invention, the high BTU waste material is subjected to pyrolitic incineration in the absence of air to provide only partial combustion of the material and minimize the generation of fly ash.

The high BTU components are separated from the combustion gases in the liquid gas separator through condensation and are not combusted, thus reducing the overall generation of heat from the combustion process and correspondingly reducing the volume of corrosive and polluting gases.

Other objects and advantages will appear during the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

The drawings illustrate an apparatus for incinerating waste material, and in particular to incinerating the substantially non-metallic residue or "fluff" from a vehicle shredding operation. In general, the "fluff" consists of small pieces or fragments, up to several inches in size, composed of materials such as rubber, plastic, insulation, paint, glass and the like. The fluff may also contain up to about 10% of metal, primarily non-ferrous metals. Because of the presence of the materials such as rubber, plastic and the like, the fluff has a very high BTU value, and cannot be incinerated normal procedures.

The apparatus includes a generally cylindrical refractory lined furnace 1, which is mounted on a frame 2, and an inclined rotary drum 3 is mounted for rotation within furnace 1.

Figure 2:
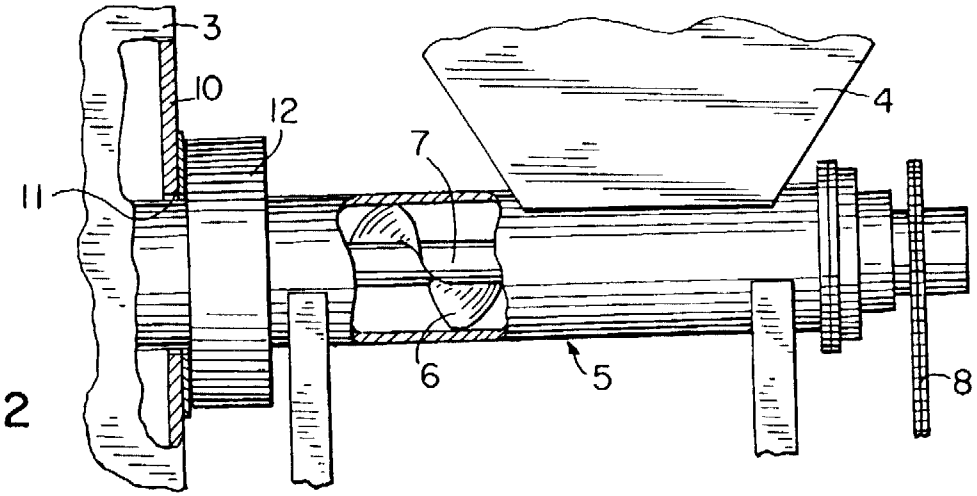
FIG. 2 is an enlarged fragmentary, longitudinal section, with parts broken away in section, showing the connection of the feed auger to the rotary drum.
Figure 3:
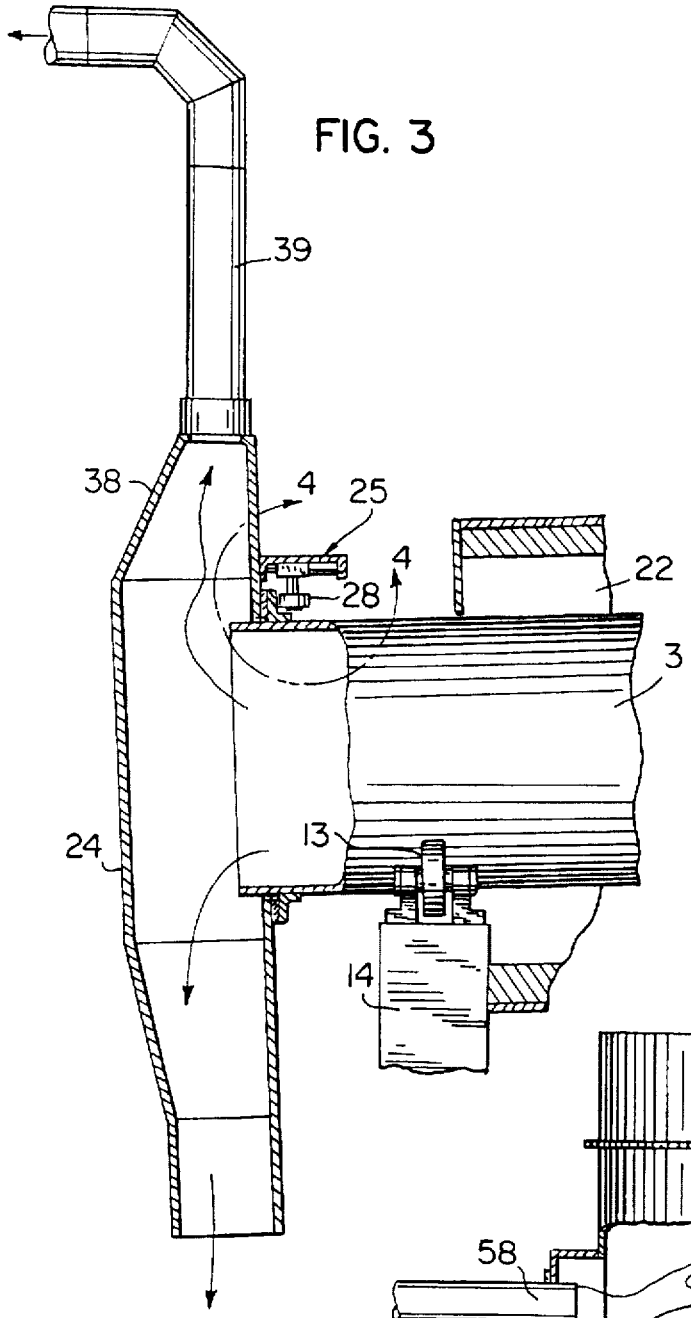
FIG. 3 is an enlarged fragmentary longitudinal section showing the connection of the discharge hood to the discharge end of the rotary drum.
Figure 6:
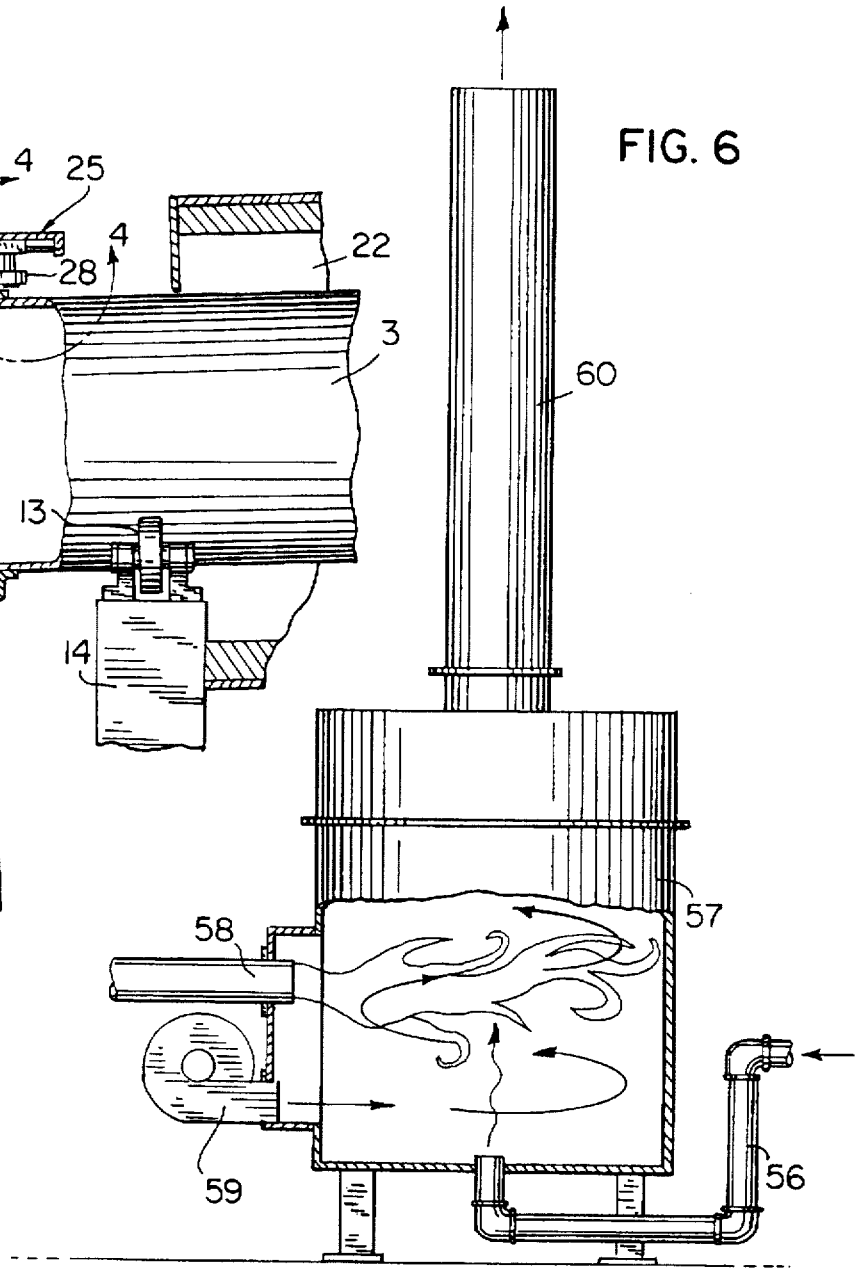
FIG. 6 is an enlarged side elevation of the afterburner with parts broken away in section

The waste material to be incinerated is fed into the upper end of a hopper 4 and conveyed from the lower end of the hopper tro the upper or high end of drum 3 by an auger feeder 5, as best seen in FIG. 2. Auger feeder 5 includes a spiral flight 6 which is mounted on a central shaft 7 and one end of the shaft projects from the feeder 5 and is connected via a chain drive 8 to a motor and transmission unit 9 mounted on frame 2. With this arrangement, operation of the drive unit 9 will rotate the spiral flight to convey the waste material from hopper 4 into drum 3. The furnace, rotary drum and feeding mechanism can be similar to those described in U.S. Pat. No. 4,941,822.

The waste material is subjected to pyrolitic incineration in drum 3, and thus the drum is substantially sealed so that the combustion takes place in the absence of air, other than air being brought in with the waste material through the auger feeder 5.

To provide the sealed conditions, the upper end of the rotating drum 3 is closed off by an end wall 10, having a central opening 11 to receive the auger 5, as shown in FIG. 2. The rotating drum 3 is sealed to the fixed auger 5 through a seal mechanism 12 of the type described in U.S. Pat. No. 4,941,822. The seal 12 permits the drum 3 to rotate relative to auger 5, but prevents the ingress of air at the joint therebetween.

Drum 3 can be rotated within furnace 1 in the manner as described in U.S. Pat. No. 4,941,822. In this regard, a pair of idler rollers 13 are mounted on frame members 14 and rotatably support the lower or discharge end of drum 3. A second pair of rollers 15 are mounted for rotation on frame members 16 and engage a track 17 which extends circumferentially around the upper end of drum 3. The rollers 13 and 15 thus support drum 3 for rotation within furnace 1.

To drive the drum, a sprocket 18 is secured to the outer surface of the projecting end of drum 3 adjacent track 17, and the sprocket is connected through a chain drive to a suitable motor and transmission unit, not shown, which is mounted on frame 2. Operation of the motor will rotate drum 3 within furnace 1.

A group of fuel burners 20 are mounted in the lower end of furnace 1, and serve to supply a combustible mixture of gas fuel and air to the annular space 22 between drum 3 and furnace 1. The combustible gas mixture is ignited by a suitable ignition mechanism, and serves to heat the waste material which is being conveyed through drum 3. Burners 20 are generally used at the startup of the operation. Once the pyrolitic combustion has started, the heat generated by the combustion of the waste material will normally be sufficient to carry on the process without operation of burners 20. In practice, it is desirable to maintain the temperature in drum 3 at a value of about 1300° to 1600° F., and operation of burners 20, as well as the introduction of a coolant into the annular space between furnace 1 and drum 3 can be used to maintain the temperature at this range. The gases resulting from the combustion of the burner gas can be discharged from furnace 1 through a series of vents or flues 23.

A plurality of longitudinal baffles, not shown, can be mounted in drum 3 as described in U.S. Pat. No. 4,941,822. As drum 3 rotates, the baffles will engage and lift the waste material to provide more uniform heating.

As the waste material passes through drum 3 and is heated therein, partial combustion and pyrolitic decomposition will occur, resulting in the generation of combustible gases as well as a solid residue consisting of non-combustible material, such as metal, carbon, and the like. The combustible gases consist of a complex mixture of low boiling point hydrocarbon gases, such as methane, ethane, carbon dioxide, carbon monoxide, and the like, along with higher boiling hydrocarbon gases and water vapor.

Figure 4:
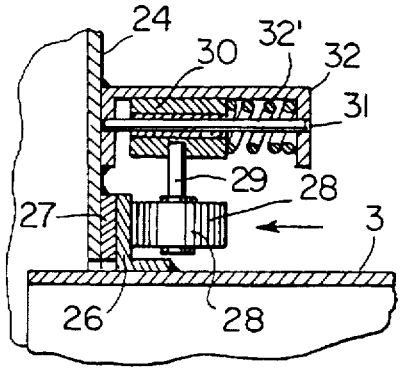
FIG. 4 is an enlarged fragmentary longitudinal section showing the connection of the rotary drum to the discharge hood.

The combustion gases, as well as the solid residue, are discharged from the lower end of the inclined drum 3 into a discharge hood 24. As the drum 3 rotates and hood 24 is fixed, a rotary seal 25 is provided to prevent the entry of air at the junction therebetween. Seal 25 is best shown in FIG. 4, and consists of a radial flange 26 formed on the downstream end of drum 3, which rides against an annular plate 27, formed of bronze or the like, which is mounted around an opening in hood 24. Flange 26 is urged against plate 27 by a series of rollers 28 that are mounted on shafts 29. The shaft 29 of each roller 28 is connected to a slide 30 that is mounted for sliding movement on rod 31. Rod 31 is attached to bracket 32 that is secured to hood 24. A spring 31 is connected between bracket 32 and slide 30, and serves to urge the roller 28 against flange 26, thus providing a seal between the rotating drum flange 26 and the fixed plate 27 on hood 24.

The solid residue being discharged from drum 3 will fall downwardly within hood 24 and can be collected in a suitable collection site. In practice, a sealing mechanism can be incorporated with the lower end of hood 24 to discharge the collected solid residue either continuously or intermittently, and prevent the entry of air into hood 24. The combustion gases entering hood 24 are discharged through the upper end of the hood.

Figure 1:
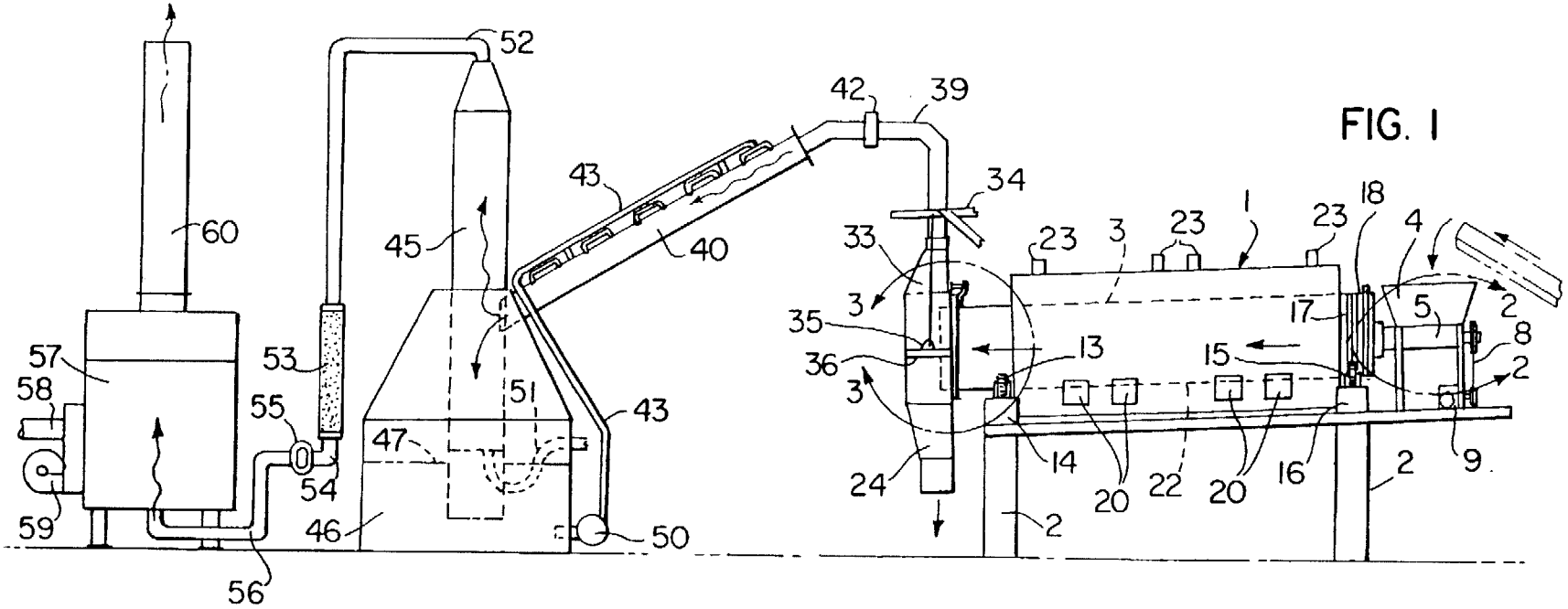
FIG. 1 is a side elevation of the apparatus of the invention.

Because of the high temperatures to which drum 3 is subjected in operation, the drum may expand by several inches longitudinally. To accommodate this expansion and contraction, hood 24 is mounted to move with drum 3. In this regard, a pair of cables 33 are suspended from frame members 34 that are located on either side of hood 24. The lower ends of cable 33 are connected to eyes 35 that are mounted on brackets 36 on either side of hood 24, as shown in FIG. 1. With this construction, hood 24 can move in a general horizontal path to accommodate expansion and contraction of drum 3, and maintain the seal therebetween.

The combustion gases being discharged from the upper end 38 of hood 24 are conducted through a conduit 39 to condenser 40. Conduit 39 can be formed in a pair of sections which are connected by a suitable expansion joint 42, thus enabling the hood 24 to move with expansion and contraction of drum 3 while maintaining the connection to the condenser 40.

Figure 5:
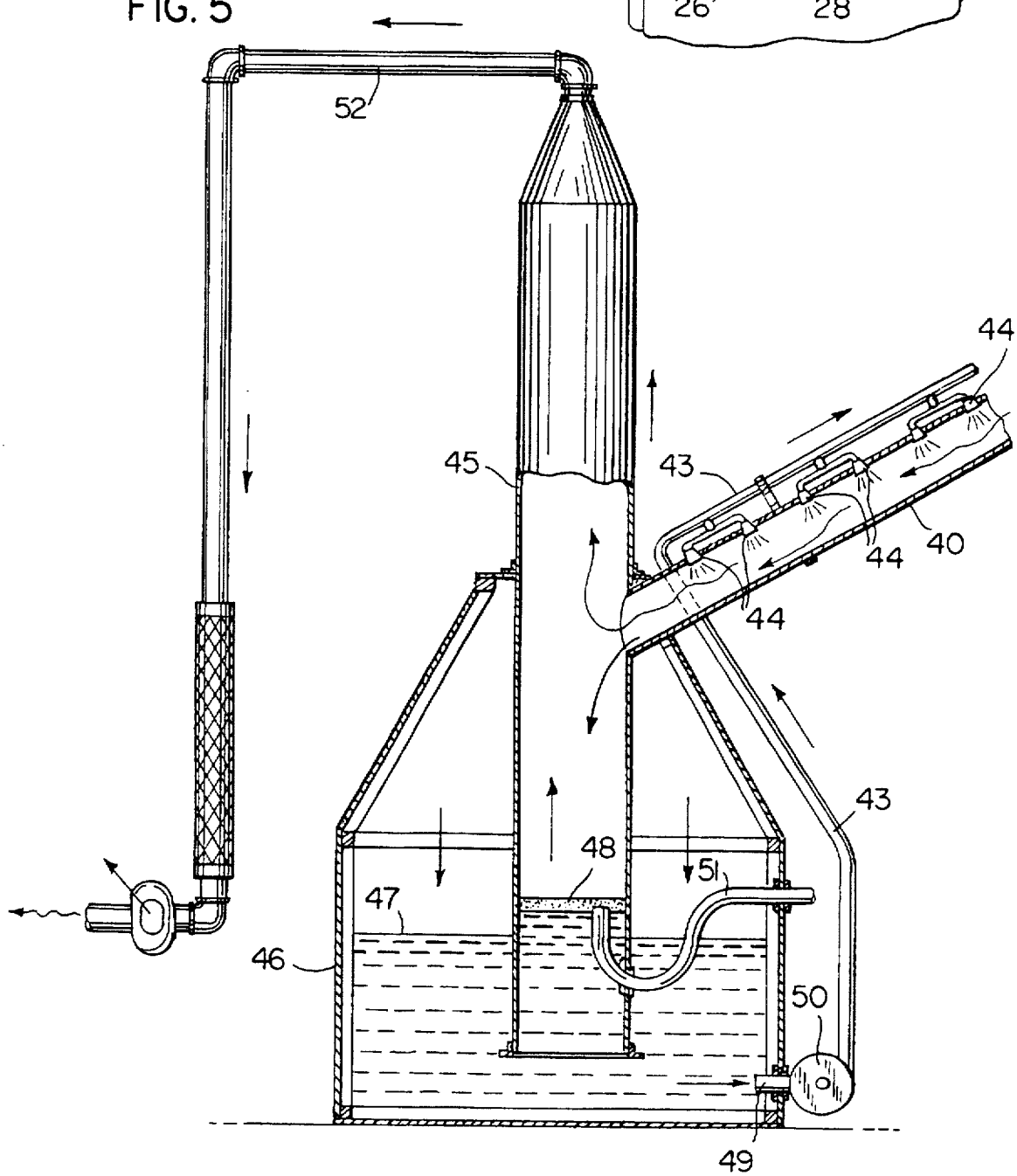
FIG. 5 is an enlarged side elevation with parts broken away in section of the condenser and liquid-gas separator.

In the condenser 40, the combustion gases are cooled to a temperature below 212° F., and generally in the range of about 90° F. to 175° F. Cooling of the gases to this temperature range will result in the condensation of water vapor as well as the condensation of the higher boiling point hydrocarbon gases. The cooling can be achieved by introducing cooling water into contact with the gases in the condenser. As best shown in FIG. 5, cooling water in line 43 can be discharged through a series of jets or nozzles 44 into the condenser 40, and into contact with the combustion gases flowing through the condenser, thus cooling the gases to the aforementioned temperature range.

The lower or downstream end of condenser 40 is connected to the central portion of a vertical liquid-gas separator 45. The condensed water vapor, as well as the condensed hydrocarbons, being discharged from condenser 40 will flow downwardly in separator 45, while the remaining hydrocarbon gases will flow upwardly through the separator.

As best shown in FIG. 5, the lower end portion of separator 45 extends into a tank 46 containing water, and the lower extremity of separator 45 is beneath the water level, indicated by 47. The condensed water vapor flowing into separator 45 will mix with the water in tank 46, while the condensed hydrocarbons, consisting of oils and/or tars, will collect as an oleophilic or oil layer 48 in the lower end of separator 45. As shown in FIG. 5, the liquid level in separator 45 will be higher than the liquid level in tank 46, due to the vacuum which is being drawn in the separator 45.

As a feature of the invention, the water in tank 46 can be used as a coolant in condenser 40. A line 49 connects the lower end of tank 46 to the suction side of a pump 50, while the discharge side of the pump is connected to line 43. With this construction, operation of the pump will deliver water to the condenser 40.

Depending on the amount of oil or liquid hydrocarbons that are collected in separator 45, the oil can be continuously or periodically removed. This can be accomplished by connecting a siphon line 51 to the separator 45 at the level of the oil layer 48. As shown in FIG. 5, the siphon line can extend outwardly through a suitable opening in the wall of tank 46.

The non-condensed hydrocarbon gases are discharged from the upper end of separator 45 through a conduit 52, and conduit 52 is connected through a flexible joint 53 to a conduit 54 that is connected to the suction side of a blower 55. The discharge side of blower 55 is connected via conduit 56 to the lower end of an afterburner 57. Operation of blower 55 provides the draft for drawing the gases through the entire system.

Afterburner 57 is of conventional construction, and serves to provide substantially complete combustion of the combustible material in the gas. In this regard, a fuel burner 58 and air blower 59 can be connected to the afterburner. The air will mix with the combustion gas to provide a combustible gas mixture which is then ignited and fully combusted through operation of burner 58, and the residual gas is discharged from afterburner 57 through stack 60.

Alternately, the low boiling point hydrocarbon gases, such as methane, ethane, and the like, being discharged from separator 45, can be collected and subsequently used as a fuel.

With the construction of the invention, the high BTU hydrocarbon components are removed from the combustion gas by condensation and are not combusted. This substantially reduces the overall heat generated by the incineration process, and also decreases the volume of corrosive and hazardous gases that are evolved from the process.

We claim:

1. An apparatus for incinerating waste material having a high BTU value, comprising pyrolytic combustion means for combusting waste material in a substantial absence of air to produce hydrocarbon combustion gases, water vapor and a solid residue, first separating means communicating with said pyrolitic combustion means for separating said combustion gases and water vapor from said solid residue, condenser means connected to said first separating means for cooling the combustion gases and water to a temperature below 212° F. to thereby condense said water vapor and condense higher boiling point hydrocarbon gases and produce hydrocarbon liquid, second separating means connected to said condenser means for separating the condensed water vapor and hydrocarbon liquid from lower boiling hydrocarbon gases, and third separating means for separating the condensed water vapor from the hydrocarbon liquid.

2. The apparatus of claim 1, wherein said pyrolytic combustion means comprises a rotatable inclined drum, feeding means for feeding the waste material to an upper end of said inclined drum, means for rotating the drum to cause the waste material to be conveyed downwardly through said drum to said first separating means, and heating means for heating the waste material in the drum.

3. The apparatus of claim 2, and including means for mounting the drum for rotation relative to said feeding means and relative to said first separating means.

4. The apparatus of claim 3, and including first sealing means for sealing said feeding means to the upper end of said inclined drum to prevent air from entering said drum.

5. The apparatus of claim 4, and including second sealing means for sealing the lower end of the inclined drum to said first separating means.

6. The apparatus of claim 5, wherein said first separating means comprises a fixed discharge hood, and means for mounting the hood for free linear movement in a direction generally parallel to the axis of said drum to accommodate expansion and contraction of said drum.

7. The apparatus of claim 5, wherein said second sealing means comprises an annular surface on the lower end of said drum, a second annular surface on said discharge hood and disposed in engagement with said first annular surface, and biasing means for urging said surfaces into sealing engagement.

8. The apparatus of claim 7, wherein said first annular surface comprises a radial flange on the lower end of said drum, said biasing means comprises a plurality of rollers mounted on said hood and engaged with said flange, and spring means operably connected to said rollers to urge said rollers against said flange.

9. The apparatus of claim 1, wherein said condenser means includes means for supplying cooling water to said combustion gases to thereby cool said gases below said temperature.

10. The apparatus of claim 1, wherein said second separating means comprises a vertical tubular member connected to a discharge end of said condenser means, a tank containing a body of water, a lower end of said tubular member being located beneath the level of water in said tank whereby said condensed water vapor will mix with the water in the tank and said hydrocarbon liquid will collect as an oil layer on the top of the water in said tubular member.

11. The apparatus of claim 10, and including removal means for removing said oil layer from said tubular member.

12. The apparatus of claim 11, wherein said removal means comprises a conduit extending through an opening in said tubular member and communicating with the interior of said tubular member at the location of said oil layer.

13. The apparatus of claim 10, and including pumping means for circulating water from said tank to said condenser means.

14. The apparatus of claim 1, and including combustion means for combusting the low boiling point hydrocarbon gases being discharged from said second separator means.

15. In a method of incinerating particulate material generated from the shredding of vehicles, the steps comprising pyrolytically incinerating particulate waste material to generate combustion gases including high boiling point hydrocarbon gases, low boiling point hydrocarbon gases, water vapor, and a solid residue, separating the solid residue from said hydrocarbon gases and said water vapor, cooling said hydrocarbon gases and said water vapor to a temperature below 212° F. to condense said high boiling point hydrocarbon gases to produce a hydrocarbon liquid and condensing said water vapor to provide water, and separating the low boiling point hydrocarbon gases from said hydrocarbon liquid and said water, and separating said hydrocarbon liquid from said water.

16. The method of claim 15, including the further step of combusting the low boiling point hydrocarbon gases in the presence of oxygen to substantially fully combust the combustible material in said gases.

17. The method of claim 15, and including the step of introducing the hydrocarbon liquid and condensed water into a body of water, collecting the hydrocarbon liquid as a hydrocarbon layer on said body of water.

18. The method of claim 17, and including the step of removing said hydrocarbon layer from said body of water.

19. In a method of incinerating particulate material resulting from the shredding of vehicles, comprising the steps of introducing particulate waste material containing both metallic and non-metallic materials into a rotatable drum, subjecting the material in said drum to pyrolytic combustion in the substantial absence of air to thereby generate high boiling point hydrocarbon gases, low boiling point hydrocarbon gases, water vapor, and a solid residue, separating the solid residue from said gases and said water vapor while maintaining the gases in an atmosphere substantially devoid of oxygen; passing the gases and said water vapor through a condenser to cool said gases and said water vapor to thereby condense said high boiling point hydrocarbon gases and produce a hydrocarbon liquid and to condense said water vapor to produce a water condensate, separating the low boiling point hydrocarbon gases from said hydrocarbon liquid and said water condensate in a liquid-gas separator, introducing said hydrocarbon liquid and said water condensate into a body of water whereby said water condensate will mix with said body of water and said hydrocarbon liquid will collect as a hydrocarbon layer on said body of water, and removing said hydrocarbon layer from said body of water.

20. The method of claim 19, and including the step of mixing the low boiling point hydrocarbon gases being discharged from said liquid-gas separator with air to provide a combustible mixture, and combusting said mixture.

21. The method of claim 19, wherein the step of separating said solid residue comprises discharging the solid residue along with said gases and said water vapor from said drum into a vertical discharge hood with said solid residue falling by gravity to the bottom of said hood for collection and said gases and said water vapor being discharged from the upper end of said hood.

22. The method of claim 21, and including the step of mounting the discharge hood for movement in a direction generally parallel to the axis of said drum to enable said hood to accommodate longitudinal expansion and contraction of said drum.

* * * * *